US005699935A

United States Patent [19]

Stahley

[11] Patent Number: 5,699,935

[45] Date of Patent: Dec. 23, 1997

[54] INVERTING BAG CO-DISPENSER

[75] Inventor: Robert E. Stahley, Middletown, Ohio

[73] Assignee: The Procter & Gamble Company, Cincinnati, Ohio

[21] Appl. No.: 588,488

[22] Filed: Jan. 18, 1996

[51] Int. Cl.[6] ..... B67D 5/52

[52] U.S. Cl. ..... 222/94; 222/95; 222/105; 222/137; 222/326

[58] Field of Search ..... 222/92, 94, 95, 222/105, 107, 137, 319, 320, 325, 326, 327, 386.5

[56] References Cited

U.S. PATENT DOCUMENTS

| | | | |
|---|---|---|---|
| 3,166,221 | 1/1965 | Nielsen | 222/137 |
| 3,323,682 | 6/1967 | Creighton, Jr. | 222/94 |
| 4,236,516 | 12/1980 | Nilson | 222/95 X |
| 4,801,046 | 1/1989 | Miczka | 222/95 |
| 4,842,165 | 6/1989 | Van Coney | 222/95 |
| 4,880,125 | 11/1989 | Lebeau . | |
| 4,972,969 | 11/1990 | Randkley | 222/94 X |
| 4,989,758 | 2/1991 | Keller | 222/137 |
| 5,020,694 | 6/1991 | Pettentgill | 222/137 |
| 5,184,757 | 2/1993 | Gianuzzi | 222/94 X |
| 5,295,615 | 3/1994 | Gentile | 222/327 |
| 5,305,920 | 4/1994 | Reiboldt et al. | 222/95 |
| 5,332,122 | 7/1994 | Herold et al. | 222/105 |
| 5,332,124 | 7/1994 | Cancro et al. | 222/137 |
| 5,335,827 | 8/1994 | Gentile | 222/137 |
| 5,348,392 | 9/1994 | Bouquet et al. | 366/162 |
| 5,443,181 | 8/1995 | Popp et al. | 222/95 |
| 5,547,107 | 8/1996 | Boiardi | 222/320 X |

FOREIGN PATENT DOCUMENTS

| | | | |
|---|---|---|---|
| 441538 | 8/1991 | European Pat. Off. | 222/326 |
| 100298 | 1/1925 | Germany | 222/326 |
| 461207 | 1/1951 | Italy | 222/326 |
| 136996 | 12/1929 | Switzerland | 222/326 |

OTHER PUBLICATIONS

Article from Research Disclosure, Jun. 1995, p. 375.

*Primary Examiner*—Kevin P. Shaver
*Attorney, Agent, or Firm*—Ronald W. Kock

[57] ABSTRACT

An inverting bag co-dispenser for dispensing a plurality of fluids simultaneously but separately through, a spout and, with a predetermined discharge volume ratio for each fluid. An upper portion defining a housing has a spout connected thereto. The housing has an outer wall and a plurality of side-by-side annular members supported internally to the outer wall. A plurality of fluid containing flexible bags are connected to and supported in the upper portion, one each of the bags being located inside one each of the side-by-side annular members and in fluid communication with the spout. The bags have closed bottoms, perimeters slidably fitting inside the annular members, and a bag wall thickness. A bottom portion has a base and an outer wall extending upwardly therefrom. The bottom portion also has a plurality of upright posts connected to the base and located inside the outer wall. The outer wall of the upper portion telescopingly engages the outer wall of the bottom portion such that one each of the plurality of posts is located axially aligned with one each of the plurality of flexible bags suspended from the upper portion. The plurality of posts are sized to cause the flexible bags to invert when the upper portion is pressed downward relative to the bottom portion to dispense fluid from the co-dispenser through the spout.

14 Claims, 2 Drawing Sheets

INVERTING BAG CO-DISPENSER

FIELD OF THE INVENTION

The present invention relates to co-dispensing fluid pumps and more particularly to such pumps wherein the volume dispensed from each fluid reservoir is a function of reservoir displacement when pressed against rigid posts. Even more particularly, the present invention relates to such pumps wherein the fluid reservoirs are flexible bags.

BACKGROUND OF THE INVENTION

Dispensing multiple fluid components in accurate proportions has been a long standing need. Such components typically have to be kept apart until the time of dispensing to prevent premature reaction between them. Vacuum type pump dispensers and dual compartment tubes are readily available. However, differences in fluid rheology cause one fluid to flow differently than the other when such dispensers are actuated. As a result, proportions dispensed are often inaccurate. One fluid reservoir may even run out of fluid before the other.

Positive displacement pumps for simultaneous dispensing of multiple fluids in accurate proportions have become available recently. An example is the Mentadent™ toothpaste co-dispenser, a Trademark of Chesebrough-Pond's USA Co. of Greenwich, Conn. The Mentadent co-dispenser has an upper portion containing two cylinders, each filled with different components of a toothpaste. At the end of each cylinder is a piston frictionally engaged in its cylinder to prevent leakage of toothpaste fluid from the cylinder. The upper portion is telescopingly connected to a bottom portion having two upright posts of equal length, which are spaced apart so as to align with the cylinders of the upper portion. When a user presses downward on the upper portion, the pistons are pressed against the two fixed posts. Such pressure causes the pistons to move upward into the cylinders and to drive toothpaste fluids from each cylinder through separate discharge orifices connected to the top of the cylinders. The amount of fluid dispensed from each cylinder is determined by the distance the upper portion is pushed downward and the diameters of the two cylinders. In most cases the cylinders have a common diameter so that the same volume of fluid is dispensed from each cylinder at the same time, regardless of fluid properties.

The Mentadent positive displacement toothpaste dispenser is not without its problems. First, the pistons provide considerable fictional resistance to movement in the cylinders when they are tight enough to prevent fluid leakage. High static friction requires users to press hard to initiate dispensing. Hard pressing to initiate flow must be immediately followed by lighter pressing to control displacement in order to avoid dispensing too much fluid. Such control is difficult for many users. Second, piston and cylinder arrangements require accurately molded or machined parts for adequate fit and reproducible operation. Such part accuracy is expensive.

What is needed is a co-dispenser which has no static friction and accurate part requirements. Others have attempted to solve this problem by placing the fluid components in separate flexible bags which hang inside the cylinders. The pistons are replaced with posts nearly the diameter of the cylinders. When the upper portion of the co-dispenser is pressed downward, the posts press against the bottom of the bags and crush the bags. That is, the bags winkle axially as they shorten in length. Thin bags can be crushed nearly flat. However, even bag crushing provides frictional resistance to dispensing because as each bag is crushed, the wrinkles must slide along the cylinder walls. Also, any cocking of the upper portion relative to the bottom portion may cause the posts to jam bag wrinkles between the post and the cylinder wall. Such jamming requires lifting the upper portion and repressing without cocking.

It is an object of the present invention to provide bag reservoirs in positive displacement pumps which have minimal friction resistance to upper portion pressing so that the least possible pressing force is required of a user to co-dispense fluids. It is another object of the present invention to eliminate the possibility of bag wrinkles jamming the dispenser. It is yet another object of the present invention to minimize the amount of fluid retained in each bag after the upper portion is pressed as far into the bottom portion as it will go.

SUMMARY OF THE INVENTION

In practicing the present invention the term co-dispensing means dispensing multiple fluids, not just two fluids. That is, co-dispensing refers to two or more fluids being dispensed simultaneously from the same dispenser.

In one aspect of the present invention an inverting bag co-dispenser dispenses a plurality of fluids simultaneously but separately through a spout with a predetermined discharge volume ratio for each fluid. The co-dispenser comprises an upper portion and a bottom portion. The upper portion has a spout connected to a housing. The housing has a plurality of side-by-side annular members supported therein. A plurality of fluid-containing flexible bags are connected to and suspended from the upper portion, one each of the bags being located inside one each of the plurality of side-by-side annular members and in fluid communication with the spout. Each of the plurality of flexible bags has a closed bottom, a perimeter slidably fitting inside an annular member, and a bag wall thickness.

The bottom portion has a base and a plurality of upright posts connected to the base. The upper portion telescopingly engages with the bottom portion such that one each of the plurality of upright posts is located axially aligned with one each of the plurality of flexible bags suspended inside one each of the plurality of side-by-side annular members. The plurality of upright posts is sized to cause the plurality of flexible bags to invert when the upper portion is pressed downward relative to the bottom portion to dispense fluid from the spout of the co-dispenser. Each of the plurality of upright posts has a rounded end and an outer dimension which is less than an inner dimension of a mating annular member by about 0.75 mm more than four of the bag wall thicknesses.

The plurality of flexible bags may be interconnected to form a cartridge and the plurality of side-by-side annular members may be removable such that an empty cartridge of flexible bags is replaceable in the upper portion with a full cartridge of flexible bags.

The plurality of side-by-side annular members may each have a common inner dimension so that the ratio of fluid dispensing is 1:1. The plurality of flexible bags preferably comprises a tri-laminated structure of polypropylene, metalized polyester, and polypropylene, having the bag wall thickness of 0.04 mm. The plurality of flexible bags may be two bags filled with two separate toothpaste components, for example.

BRIEF DESCRIPTION OF THE DRAWINGS

While the specification concludes with claims which particularly point out and distinctly claim the present invention, it is believed that the present invention will be better understood from the following description of preferred embodiments, taken in conjunction with the accompanying drawings, in which like reference numerals identify identical elements and wherein:

DETAILED DESCRIPTION OF THE INVENTION

Figure 1:
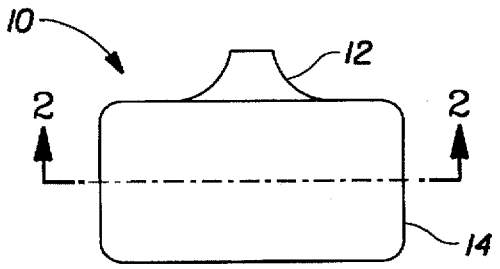
FIG. 1 is a top plan view of a preferred embodiment of the inverting bag co-dispenser of the present invention, disclosing an upper portion having a spout.
Figure 2:
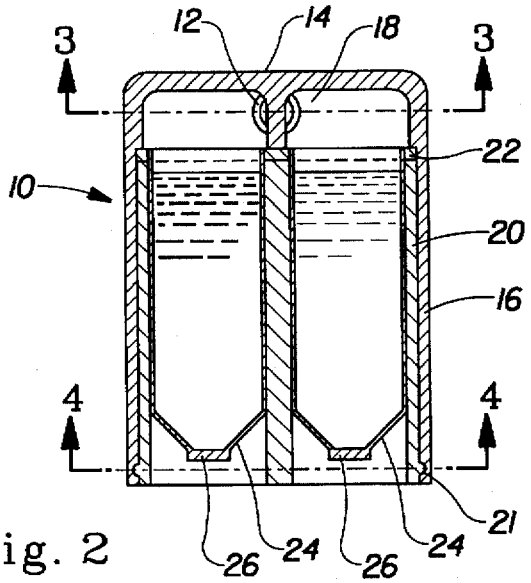
FIG. 2 is a sectioned rear elevation view thereof, taken along section line 2—2 of FIG. 1, showing an assembly of a housing with spout connected to an outer wall, a side-by-side pair of annular members, and a figure-8-shaped bag holder having two fluid filled bags attached to it suspended inside the side-by-side pair of annular members.

Referring now to the drawings, and more particularly to FIGS. 1 and 2, there is shown a preferred embodiment of the present invention, which provides an inverting bag co-dispenser upper portion, which is generally indicated as 10. Upper portion 10 defines a housing 14 and has a spout 12 connected thereto. Housing 14 has outer wall 16 and manifold 18. Spout 12 is in fluid communication with manifold 18.

Snapped into housing 14 is a pair of side-by-side annular members 20. Pair of side-by-side annular members 20 is shown with snap beads 21 near its bottom end. Housing 14 preferably has a snap groove which mates with snap beads 21 to hold snap beads 21 in place. There may be a plurality of more than two such side-by-side annular members 20. They may be snapped in place as an assembly or independently connected to housing 14. Plurality of annular members 20 may even be molded integrally with two halves of housing 14. Plurality of annular members 20 may also be press fit into housing 14 or be removably attached to housing 14, individually or as a group. Each annular member is preferably parallel to the others in an upright orientation, and each annular member preferably has substantially straight inner walls. In the preferred embodiment shown, each annular member has cylindrical inner walls; however, the shape of such inner walls may be oval or any other substantially smooth shape. The inner wall of each annular member is also preferably continuous, but it may be discontinuous if no sharp edges are present.

Located between the top of side-by-side annular members 20 is a bag holder 22. Bag holder 22 has a pair of open loops into which are sealed the open ends of a pair of flexible bags 24 by means of thermobonding or adhesive bonding. Pair of flexible bags 24 have closed ends 26, which are preferably heat sealed closed. Pair of flexible bags 24 are suspended from bag holder 22 such that they may fit into side-by-side annular members 20 with closed ends 26 near the bottom ends of annular members 20. Alternatively, pair of flexible bags 24 may be thermoformed from bag holder 22. A plurality of more than two flexible bags may be suspended from bag holder 22 such that each flexible bag is aligned with and is shaped to slidably fit into a, corresponding annular member. Each flexible bag 24 is filled with a different fluid. The open end of each suspended flexible bag is in fluid contact with manifold 18.

A cartridge for replacing emptied bags may include a peelable film seal to maintain the open ends of filled bags closed until the cartridge is ready to be placed into the upper potion. Also, the film may be puncturable to open it.

Figure 3:
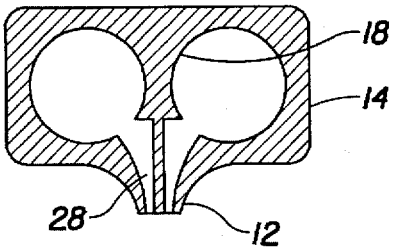
FIG. 3 is a sectioned bottom plan view thereof, taken along section line 3—3 of FIG. 2, showing the fluid connection of the spout in the housing to a manifold above each annular member.

FIG. 3 shows manifold 18 and its separate passageways 28 which lead to spout 12 such that the different fluids are always maintained separated until dispensed from spout 12.

Figure 4:
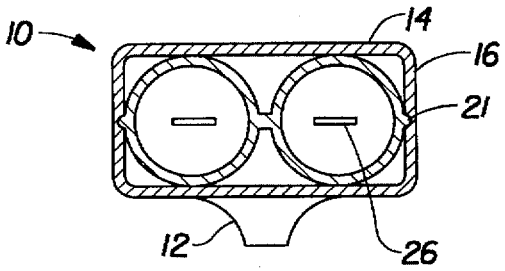
FIG. 4 is a sectioned bottom plan view thereof, taken along section line 4—4 of FIG. 2, showing the side-by-side pair of annular members snapped into the housing, trapping the figure-8-shaped bag holder between the housing and the side-by-side pair of annular members.

FIG. 4 shows the bottom end of housing 14, looking up at the closed ends 26 of flexible bags 24. The section is taken through outer wall 16 of housing 14 and through pair of side-by-side annular members 20 to show snap beads 21 engaged with a snap groove of outer wall 16. Closed ends 26 of flexible bags 24 are shown gathered and flattened and heat sealed near the center of each bag. Other bag closing arrangements are possible, such as a twist seal, which is heat sealed. The bag may also be formed with one end closed as the folded end of two flat halves of film that are fin-sealed together.

Figure 5:
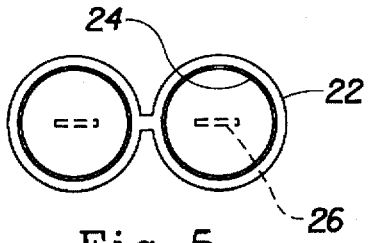
FIG. 5 is a top plan view of the figure-8-shaped bag holder of FIG. 2, showing bags sealed to the inside of two bag holder loops and a different fluid filling each bag.
Figure 6:
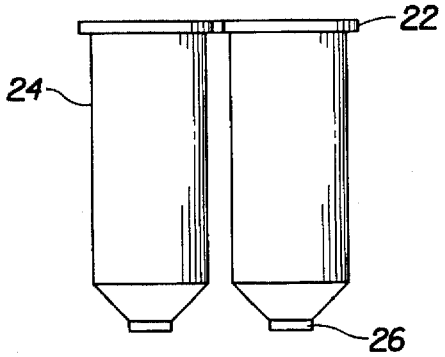
FIG. 6 is a front elevation view of the bag holder of FIG. 5, showing the two bags suspended from the bag holder.

FIGS. 5 and 6 show a rigid bag holder 22 having two open loops connected together. Inside each loop is sealed a flexible bag. Each bag has an open upper end which is filled with a different fluid. Bags 24 may be sealed to bag holder 22 by adhesive or by heat sealing, preferably by a sealing tool, not shown, exerting a pressure from inside the open end of each bag. Ultrasonic sealing may also be used for this seal.

Figure 7:
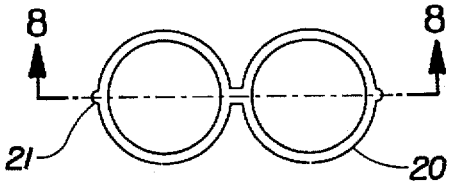
FIG. 7 is a top plan view the side-by-side pair of annular members of FIG. 2.
Figure 8:
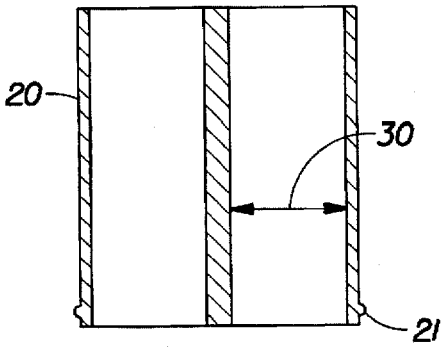
FIG. 8 is a sectioned from elevation thereof, taken along section line 8—8 of FIG. 7, showing the side-by-side pair of annular members with snap beads for connection to the housing.

FIGS. 7 and 8 show a rigid pair of side-by-side annular members 20, which have snap beads 21 and an inner dimension 30.

Figure 9:
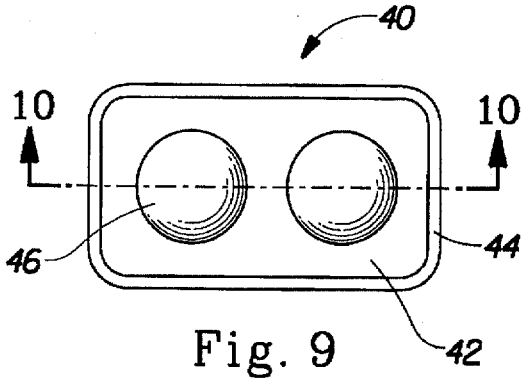
FIG. 9 is a top plan view of a preferred embodiment of the inverting bag co-dispenser of the present invention, disclosing a bottom portion having a base, an outer wall, and two upright posts.
Figure 10:
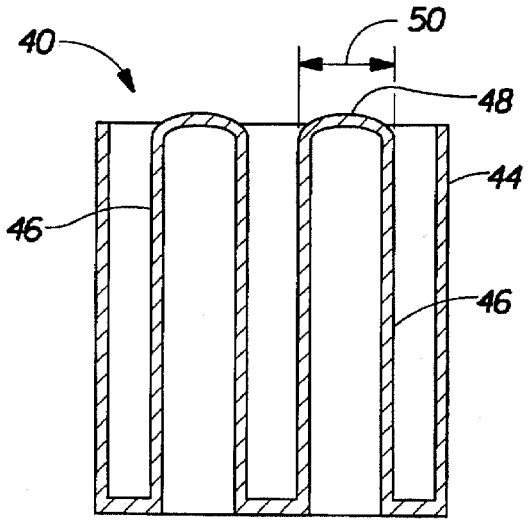
FIG. 10 is a sectioned rear elevation view thereof, taken along section line 10—10 of FIG. 9, showing the outer wall and the upright posts with rounded top ends connected to the base.

FIGS. 9 and 10 show a preferred embodiment of the present invention, which provides an inverting bag co-dispenser bottom portion, which is generally indicated as 40. Bottom portion 40 has a base 42 and an outer wall 44 extending upward from base 42. Base 42 also has a pair of upright posts 46 located internal to outer wall 44 and cantilevered from base 42. Pair of upright posts 46 have rounded ends 48. Pair of upright posts 46 are preferably rigid and are aligned with pair of side-by-side annular members 20 of upper potion 10. Pair of upright posts 46 each have an outer diameter 50 which is sized to invert a flexible bag suspended in each annular member. As with the plurality of annular members and the plurality of flexible bags, there could be a plurality of upright posts when more than two fluids are to be discharged simultaneously from the same co-dispenser. Preferably bottom portion 40 is molded in one piece.

Figure 11:
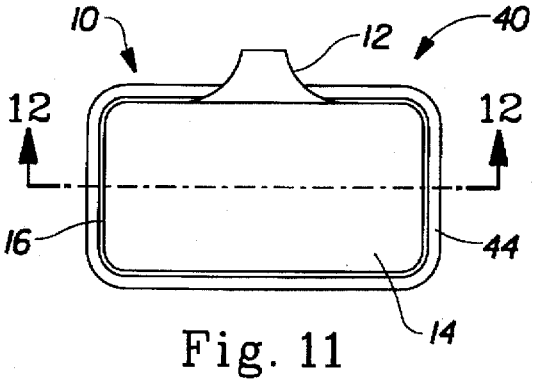
FIG. 11 is a top plan view of a preferred embodiment of the inverting bag co-dispenser of the present invention, disclosing the upper portion of FIG. 1 partially telescoped into the bottom portion of FIG. 9 to form the assembled co-dispenser.
Figure 12:
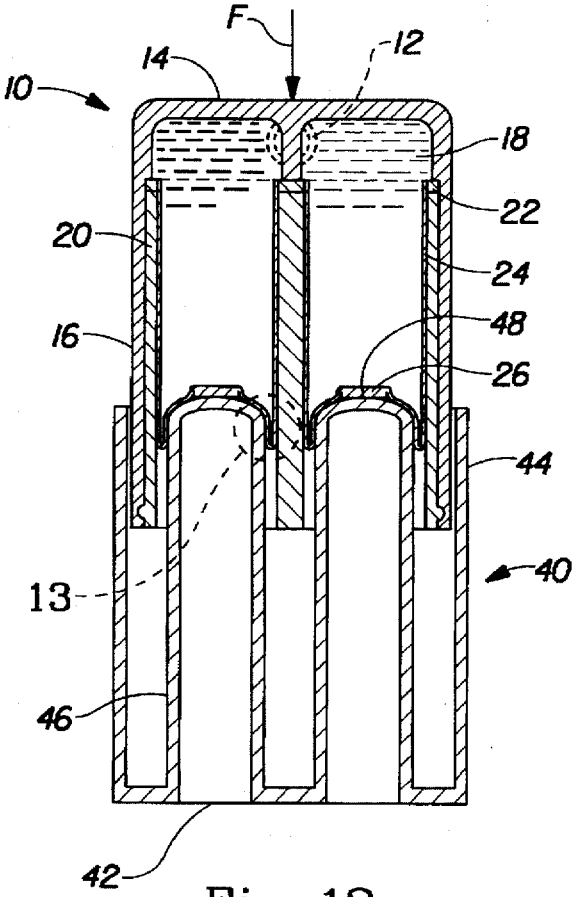
FIG. 12 is a sectioned rear elevation view thereof, taken along section line 12—12 of FIG. 11, showing how the upper portion and bottom portion of the co-dispenser telescope together such that the upright posts of the bottom portion engage the suspended bags of the upper portion to initiate bag inversion under the pressure of force F applied to the upper portion.

FIGS. 11 and 12 show upper potion 10 telescopingly engaged with bottom portion 40. FIG. 12 shows a force F applied to upper portion 10 to drive it downward relative to bottom potion 40. In the embodiment shown, upper portion 10 has outer wall 16 which slides within outer wall 44 of bottom portion 40. However, upper portion 10 could just as easily have had outer wall 16 sliding outside outer wall 44 of bottom portion 40. Alternatively, outer wall 16 and outer wall 44 may not be needed if a user carefully aligns posts with their respective annular members, since these members provide their own telescoping engagement with posts.

Figure 13:
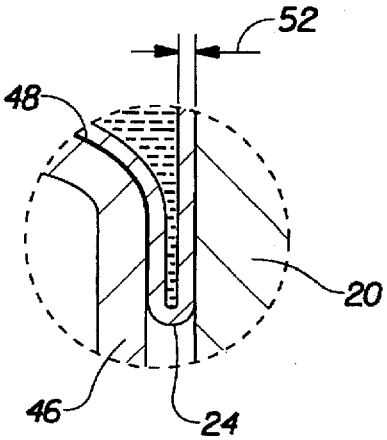
FIG. 13 is an enlarged view of a portion of FIG. 12 showing the start of bag inversion as fluid is dispensed.

FIG. 12 also shows flexible bags 24 having inversion initiated when pair of upright posts 46 contact closed ends 26 of flexible bags 24, suspended inside pair of side-by-side annular members 20. Flexible bags 24 invert because outer dimension 50 of each post is less than inner dimension 30 of side-by-side annular member 20 by at least 4 times a wall thickness 52 of each of flexible bags 24 plus 0.75 mm. This is shown more clearly in FIG. 13. The rounded end 48 of an upright post 46 causes the closed end of a flexible bag to invert when sufficient clearance is provided for the bag wall to fold inward all around the inside of an annular member. When flexible bags 24 invert, very little product remains between the overlapping walls of flexible bags 24. Also, rounded ends 48 are designed to push the closed end 26 into manifold 18 of upper portion 10 when the co-dispenser is nearly empty. If the inside of the manifold is shaped to receive the rounded end of each post with minimal clearance, little residual fluid will remain in the inverted bag. Rounded ends not only act to minimize residual product left in upper portion 24, but also, they reduce the need for accurate alignment and therefore enhance smooth inversion of flexible bags 24. Other shaped ends are useful, but rounded ends 48 are believed best.

In a particularly preferred embodiment of the present invention, upper portion 10 and bottom portion 40 are both injection molded of polypropylene. Bag holder 22 is preferably made of polypropylene, and flexible bags 24 are made of a 0.04 mm thick tri-laminate of linear low density polyethylene, metalized polyester, and linear low density polyethylene. Bag material is available from James River Corporation of Shreveport, La., as specification number 541609. Inner dimension 30 is preferably 33 mm, and outer dimension 50 is preferably 32 mm. Flexible bags 24 are preferably about 70 mm long, filled with about 52 ml of fluid. Spout 12 has a minimal opening of about 44 square mm for each fluid passage.

EXAMPLE

A first flexible bag is filled with a toothpaste component gel phase, having a viscosity of about 5000 centipoise at 100 reciprocal seconds, and a specific gravity of about 1.44; and a second flexible bag is filled with a toothpaste component baking soda paste, having a viscosity of about 12,000 centipoise at 100 reciprocal seconds, and a specific gravity of about 1.49. When the co-dispenser of the present invention is operated such that approximately 1.5 grams of total fluid is dispensed at a uniform rate of 0.5 grams/second, the value of force F is measured for a substantially full bag condition as 8.8 pounds, for a substantially half full bag condition as 8.5 pounds, and for a nearly empty bag condition as 8.6 pounds.

The same fluids and co-dispenser may be tested at the same flow rate, but with upright posts sized to just slidably fit with minimal friction within annular members. The flexible bags are crushed instead of inverted by the posts. In the crushing bag situation, the value of force F is measured approximately 46% higher than for the inverting bag situation at each of the three bag conditions: full, half full, and nearly empty. This test illustrates one of the benefits of bag inversion versus bag crushing in a co-dispenser—reduced actuating force.

While particular embodiments of the present invention have been illustrated and described, it will be obvious to those skilled in the art that various changes and modifications may be made without departing from the spirit and scope of the invention, and it is intended to cover in the appended claims all such modifications that are within the scope of the invention.

What is claimed is:

1. An inverting bag co-dispenser comprising:.

a) an upper portion defining a housing and having a spout connected thereto, said housing having a plurality of side-by-side annular members supported therein, and b) a bottom portion having a base and a plurality of upright posts connected to said base, said upper portion telescopingly engaged with said bottom portion such that one each of said plurality of upright posts is located axially aligned with one each of said plurality of side-by-side annular members, said plurality of upright posts being sized to invert a plurality of flexible bags capable of containing fluid and connected to said upper portion wherein one each of said bags is located inside one each of said plurality of side-by-side annular members in fluid communication with said spout, said plurality of flexible bags being inverted when said upper portion and said bottom portion are pressed together.

2. The inverting bag co-dispenser of claim 1 wherein each of said flexible bags has a bag wall thickness and each of said plurality of upright posts has an outer dimension which is less than an inner dimension of a mating annular member by more than four of said bag wall thicknesses.

3. The inverting bag co-dispenser of claim 1 wherein said plurality of flexible bags are replaceable in said co-dispenser.

4. The inverting bag co-dispenser of claim 3 wherein said plurality of flexible bags are interconnected to form a cartridge.

5. An inverting bag co-dispenser for dispensing a plurality of fluids simultaneously but separately through a spout with a predetermined discharge volume ratio for each fluid, said co-dispenser comprising:

a) an upper portion defining a housing and having a spout connected thereto and said housing having a plurality of side-by-side annular members supported therein;

b) a plurality of fluid-containing flexible bags connected to and suspended within said upper portion, one each of said bags being located inside one each of said plurality of side-by-side annular members and in fluid communication with said spout, each of said plurality of flexible bags having a closed bottom, a perimeter slidably fitting inside an annular member, and a bag wall thickness;

c) a bottom portion having a base and a plurality of upright posts connected to said base, said upper portion telescopingly engaged with said bottom portion such that one each of said plurality of upright posts is located axially aligned with one each of said plurality of flexible bags suspended inside one each of said plurality of side-by-side annular members, said plurality of upright posts being sized to cause said plurality of flexible bags to invert when said upper portion is pressed downward relative to said bottom portion to dispense fluid from said spout of said co-dispenser.

6. The inverting bag co-dispenser of claim 5 wherein each of said plurality of upright posts has a rounded top end and an outer dimension which is less than an inner dimension of a mating annular member by 0.75 mm more than four of said bag wall thickness.

7. The inverting bag co-dispenser of claim 5 wherein said plurality of flexible bags are interconnected to form a cartridge and said plurality of side-by-side annular members are removable such that an empty cartridge of flexible bags is replaceable in said upper portion with a full cartridge of flexible bags.

8. The inverting bag co-dispenser of claim 5 wherein said plurality of side-by-side annular members each have a common inner dimension so that said ratio of fluid dispensing is 1:1.

9. The inverting bag co-dispenser of claim 5 wherein said plurality of flexible bags comprises a tri-laminated structure of polyethylene, metalized polyester, and polyethylene, having said bag wall thickness of 0.04 mm.

10. An inverting bag co-dispenser for dispensing two toothpaste components simultaneously but separately through a spout with a predetermined discharge volume ratio for each toothpaste component, said co-dispenser comprising:

a) an upper portion defining a housing and having a spout connected thereto, said housing having an outer wall and a pair of side-by-side annular members connected thereto internally to said outer wall;

b) a pair of toothpaste component-containing flexible bags connected to and suspended within said upper portion, one each of said pair of flexible bags being located inside one each of said pair of side-by-side annular members and in fluid communication with said spout, each of said pair of flexible bags having a closed bottom, a perimeter slidably fitting inside an annular member, and a bag wall thickness;

c) a bottom portion having a base, an outer wall extending upwardly therefrom, and a pair of upright posts connected to said base and located inside said outer wall, said outer wall of said upper portion telescopingly engaged with said outer wall of said bottom portion such that one each of said pair of posts is located axially aligned with one each of said pair of flexible bags suspended inside one each of said pair of side-by-side annular members, said pair of upright posts being sized to cause said pair of flexible bags to invert when said upper portion is pressed downward relative to said bottom portion to dispense toothpaste components from said spout of said co-dispenser.

11. The inverting bag co-dispenser of claim 10 wherein each of said pair of upright posts has a rounded end and an outer dimension which is less than an inner dimension of a mating annular member by 0.75 mm more than four of said bag wall thicknesses.

12. The inverting bag co-dispenser of claim 10, wherein said pair of side-by-side annular members each have a common inner dimension so that said ratio of toothpaste component dispensing is 1:1.

13. The inverting bag co-dispenser of claim 10 wherein said pair of flexible bags comprises a tri-laminated structure of polyethylene, metalized polyester, and polyethylene, having said bag wall thickness of 0.04 mm.

14. The inverting bag co-dispenser of claim 10 wherein said pair of flexible bags are interconnected to form a cartridge and said pair of side-by-side annular members are removable such that an empty cartridge of flexible bags is replaceable in said upper portion with a full cartridge of flexible bags.

* * * * *